US007631869B2

(12) United States Patent
Bowers et al.

(10) Patent No.: US 7,631,869 B2
(45) Date of Patent: Dec. 15, 2009

(54) SYSTEM AND METHOD FOR GAP LENGTH MEASUREMENT AND CONTROL

(75) Inventors: Brian Bowers, Mundelein, IL (US); Christopher Crutchfield, Lindenhurst, IL (US); Kenneth Yuen, Vernon Hills, IL (US); Gary Van Ermen, Palatine, IL (US)

(73) Assignee: Bowe Bell + Howell Company, Durham, NC (US)

( * ) Notice: Subject to any disclaimer, the term of this patent is extended or adjusted under 35 U.S.C. 154(b) by 58 days.

(21) Appl. No.: 11/710,911

(22) Filed: Feb. 27, 2007

(65) Prior Publication Data

US 2008/0208370 A1 Aug. 28, 2008

(51) Int. Cl.
*B65H 5/34* (2006.01)

(52) U.S. Cl. ..... 271/270; 271/2; 271/265.01; 271/265.02

(58) Field of Classification Search ..... 271/2, 271/265.01–265.03, 270; 209/584, 900
See application file for complete search history.

(56) References Cited

U.S. PATENT DOCUMENTS

| | | | | |
|---|---|---|---|---|
| 4,331,328 | A | 5/1982 | Fasig | |
| 4,933,616 | A * | 6/1990 | Chang et al. | 318/561 |
| 4,935,078 | A * | 6/1990 | Bergman et al. | 156/64 |
| 5,295,677 | A * | 3/1994 | Hutner | 271/110 |
| 5,423,527 | A | 6/1995 | Tranquilla | |
| 5,575,466 | A | 11/1996 | Tranquilla | |
| 5,692,742 | A | 12/1997 | Tranquilla | |
| 5,848,784 | A | 12/1998 | Tranquilla | |
| 6,443,311 | B2 * | 9/2002 | Hendrickson et al. | 209/542 |
| 6,499,020 | B1 * | 12/2002 | Dolan et al. | 705/406 |
| 6,547,078 | B1 * | 4/2003 | Lile et al. | 209/539 |
| 6,554,275 | B1 * | 4/2003 | Tranquilla | 271/259 |
| 6,644,660 | B2 * | 11/2003 | Sussmeier et al. | 271/270 |
| 6,711,461 | B2 | 3/2004 | Flores | |
| 7,040,616 | B2 * | 5/2006 | Stemmle | 271/270 |
| 7,439,467 | B2 * | 10/2008 | DeWitt et al. | 209/584 |
| 2003/0168798 | A1 * | 9/2003 | Tufekci et al. | 271/258.01 |
| 2004/0021261 | A1 * | 2/2004 | Auerbach | 271/2 |
| 2004/0021755 | A1 * | 2/2004 | Sussmeier | 347/104 |
| 2004/0036893 | A1 * | 2/2004 | Sussmeier | 358/1.5 |
| 2005/0171921 | A1 * | 8/2005 | Nicolas et al. | 705/406 |
| 2005/0189272 | A1 * | 9/2005 | DiBiaso et al. | 209/584 |
| 2009/0057997 | A1 * | 3/2009 | Hatada et al. | 271/270 |

* cited by examiner

*Primary Examiner*—Patrick H Mackey
*Assistant Examiner*—Jeremy Severson
(74) *Attorney, Agent, or Firm*—McDermott Will & Emery LLP

(57) ABSTRACT

The present subject matter relates generally to a system and method for controlling functions in a mail sorting system based on gap length measurement and tracking. The system and method includes a plurality of sensors located along one or more mail piece transport paths. The sensors are used to collect data regarding the gap length between each mail piece transported through the system. The gap length data is processed and stored within a controller/processor that uses the gap lengths to control the operation of one or more devices within the mail sorting system. For example, the gap lengths may be used to control the operation of a diverter, a printer or any other electromechanical, hardware or software device. The gap lengths can be used to trigger and/or inhibit the operation of the one or more devices.

26 Claims, 6 Drawing Sheets

SYSTEM AND METHOD FOR GAP LENGTH MEASUREMENT AND CONTROL

TECHNICAL FIELD

The present subject matter relates generally to a system and method for controlling functions in a mail sorting system. More specifically, the present subject matter relates to a system and method for controlling functions in a mail sorting system based on gap and/or mail piece length measurement and tracking.

BACKGROUND

Within a mail piece processing system, gap length is defined as the distance between two mail pieces, i.e., the distance between a first mail piece's trailing edge and a second mail piece's leading edge. In order for proper continuous function of a mail piece processing system, the gap length must be large enough to accommodate the time required for electromechanical devices (e.g., diverters, scales, printers, etc.) operable along the processing system's mail piece transport path to perform their functions.

As an example, in a mail sorter system, it is common to include a series of tightly positioned transport belts guided by one or more pulleys, actuators, rollers, tracks and the like to transport mail pieces from an initial feed position to an output position. Close contact between the belts and mail pieces enables the physical transport of the mail pieces. Between the input position and output position various other modules may also operate upon or interact with the mail pieces; for example, an imaging system for interpreting the markings resident upon the mail pieces or one or more scales for weighing each mail piece. A plurality of mail bins for accumulating the sorted mail pieces may be located beyond the output position. When one considers the plurality of modules and procedures that must be executed in order to direct mail pieces along the mail piece transport path at high speeds, it is evident that maintaining proper gap length between mail pieces throughout the transport path is critical. For example, if the gap length between mail pieces is too small, a diverter may not be able to divert a first piece of mail and recover in time to divert a second piece of mail or to let the second piece pass the diverter. This failure can lead to a mail piece not being diverted to its proper course or, more destructively, cause a system stoppage (e.g., due to jamming or mail pieces.)

Presently, gap length is controlled by the operation of the mail sorting system feeder at the front end of the system. Feeders operate using a set pitch; pitch being the distance between the leading edge of a first piece of mail and the leading edge of a second piece of mail. The pitch setting is generally established and controlled through the use of a processor/controller, which may regulate the timed release of mail pieces to affect the pitch, as well as control and monitor the various electromechanical devices of the sorter system. Knowing the length of the longest piece of mail fed to the feeder and operating at a set pitch allows for a minimum gap length at the output of the feeder. Alternately, a fixed gap feeder sets a fixed amount of time between detection of the trailing edge of the mail piece that just left the feeder and when the next piece is advanced out of the feeder. However, controlling gap length at the output of the feeder does not guarantee control of the gap length at all points along the mail sorting system.

The feeder is assumed to function correctly at all times, with no variation in output to the system. Unfortunately, feeders do not function perfectly at all times and it is common for gap length to vary in the output of a feeder. Stops and starts of the mail sorting system can create variations in gap lengths as certain pieces of mail may accelerate and decelerate at different rates based on the slickness of the mail pieces and belts, the thickness of the mail pieces, belt elasticity, etc. Also, gap length variations may occur due to variations in belt tension at certain points throughout the mail processing system, whether the tension variations are intentional or unintentional. For example, the belt tension (and hence hold) upon mail pieces may be intentionally lessened to allow said mail pieces to settle into a mail piece guidance track. In contrast, the belt tension may change unintentionally as a result of wear over time due to normal usage. Regardless of how it occurs, gap length variation is a common occurrence during mail processing system operation.

If mail sorting systems were able to monitor the variations in gap length along the mail piece transport path during the mail processing operations and alter one or more processes within the mail sorting system based on the variations, the mail processing system would be able to avoid costly stoppages and improve operating efficiency. Also, simply monitoring where variations in gap length are occurring could demonstrate that there is a particular point in the system that is known to cause variations in the gap length. This information could allow a system operator or monitor to identify problems in the system, for example, a failing bearing, a failing belt, a sticking point, etc.

Therefore, a need exists for a system and method in which the gap length and/or mail piece length is both measured, tracked and controlled instantaneously and at multiple positions along the mail sorting system.

SUMMARY

The present subject matter relates generally to a system and method for controlling functions in a mail sorting system based on gap length and/or mail piece length measurement and tracking. The system and method includes a plurality of sensors located along one or more mail piece transport paths. The sensors are used to collect data regarding the gap length between each mail piece transported through the system and the mail piece length. The gap length data is processed and stored within a controller/processor that uses the gap lengths to control the operation of one or more devices within the mail sorting system. For example, the gap lengths may be used to control the operation of a diverter, a printer, a labeler or any other electromechanical, hardware or software device. The gap lengths can be used to trigger and/or inhibit the operation of the one or more devices.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION OF PREFERRED EMBODIMENTS

Figure 1:
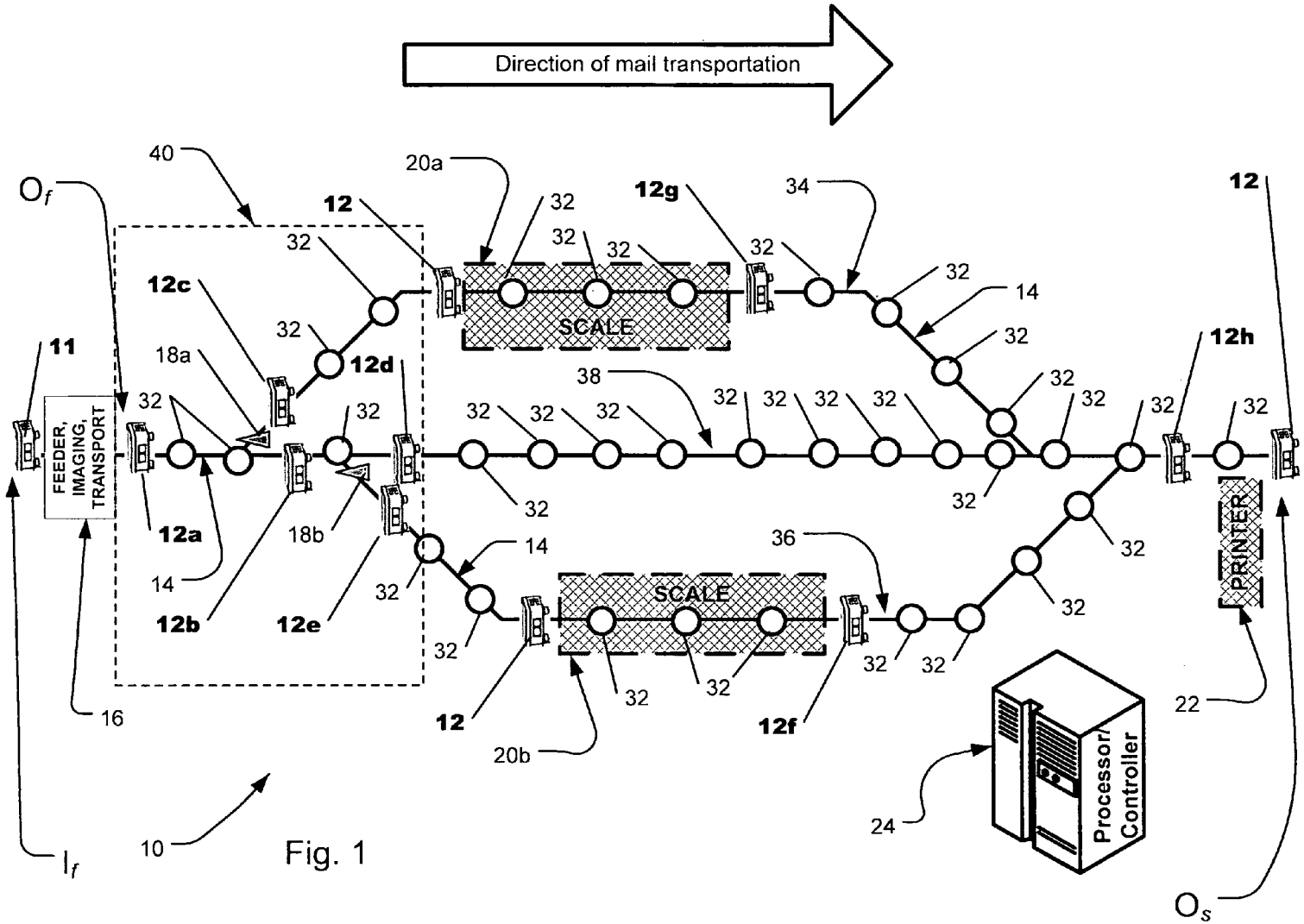
FIG. 1 is a schematic illustrating a plan view of a sorter system utilizing gap measurement, tracking and control.
Figure 2:
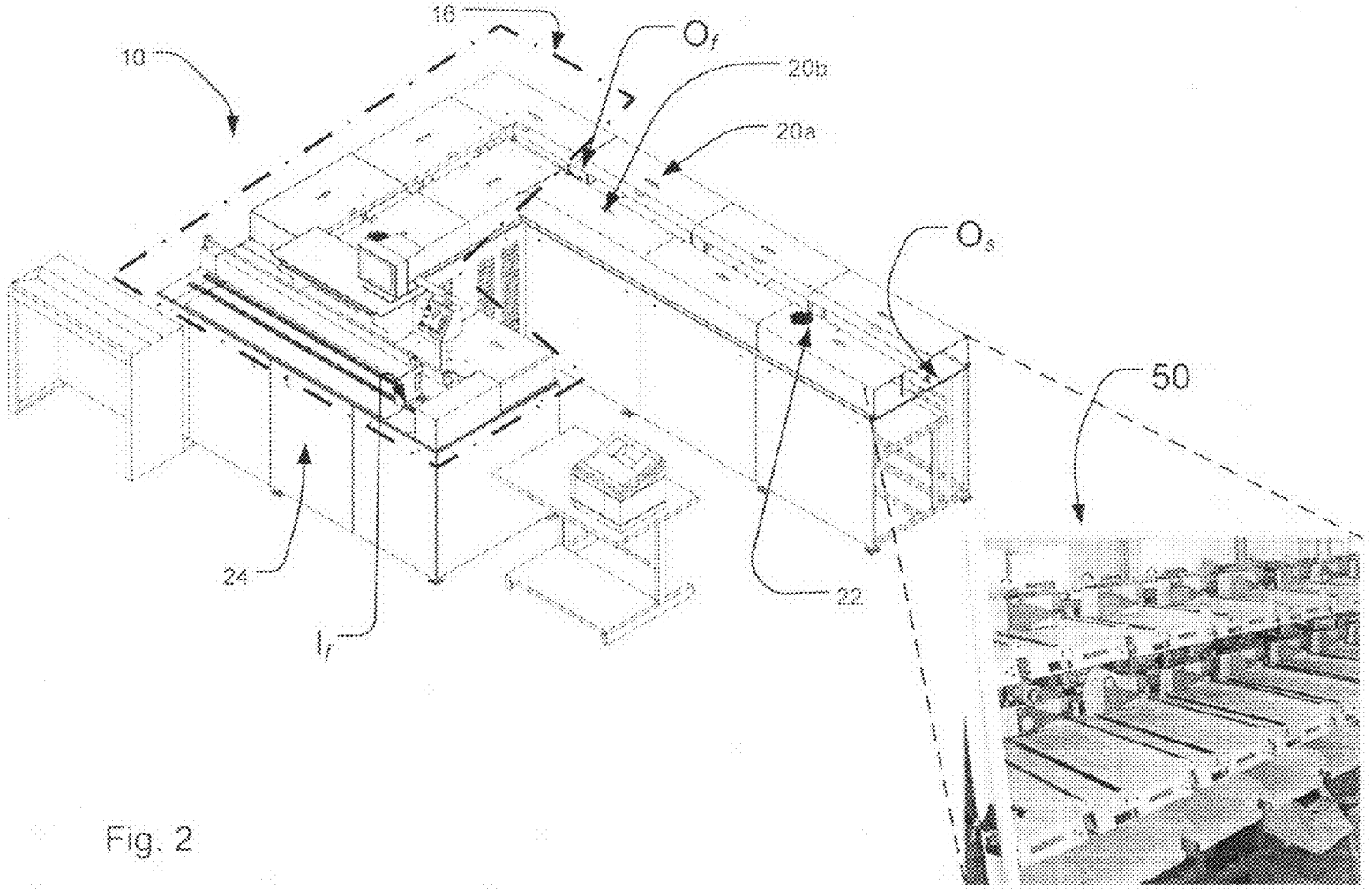
FIG. 2 is an exemplary sorter system for processing mail pieces.

FIG. 1 illustrates a mail sorting system 10 wherein sensors 12 (including sensors 12*a*-12*h*) are located in proximity to conveyor belts 14 used to transport mail pieces 26 through the mail sorting system 10. In addition to the sensors 12 and conveyor belts 14, the embodiment of the mail sorting system 10 shown in FIG. 1 includes a feeder 16, two diverters 18, two in-line scales 20 and a printer 22. The mail sorting system 10 further includes a processor/controller 24 associated with the other components of the system 10.

It is understood that any mail piece processing system (e.g., sorter, inserter reject processor, etc.) may benefit by the application of the subject matter disclosed herein. It is further understood that any electromechanical devices that may be employed in a mail processing system, particularly those having a set reaction time, may benefit by the application of the subject matter disclosed herein; for example, image lift systems, printers, labelers, diverters, etc. Therefore, the descriptions of the mail processing system, particularly the mail sorting system 10 herein, should not be limited to the configuration of devices illustrated in the example provided in FIGS. 1-4.

Figure 4:
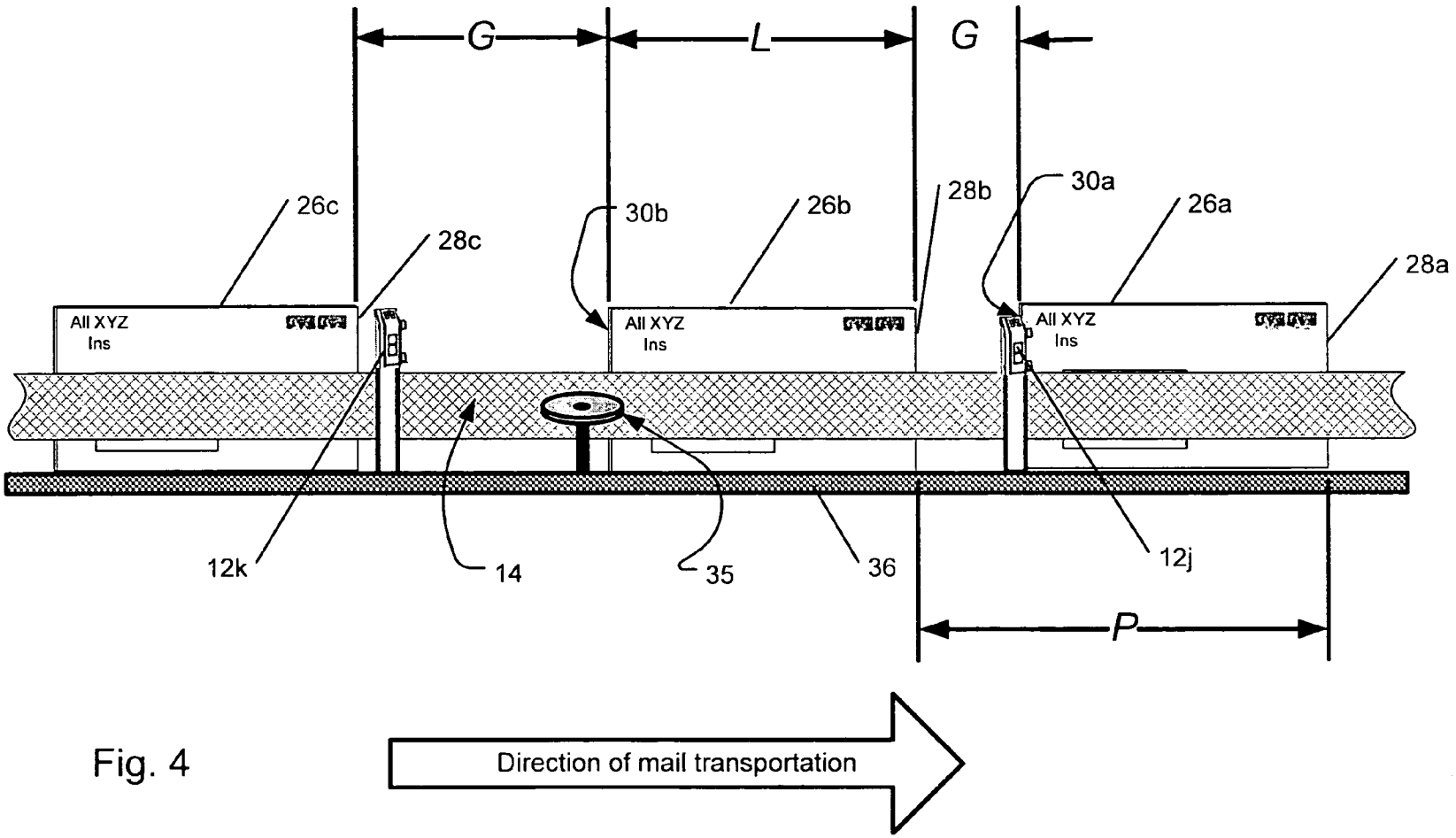
FIG. 4 is a side view illustrating mail pieces being transported within the sorter system shown in FIG. 1.

FIG. 4 illustrates a side view of mail pieces 26 being transported through the conveyor belts 14 in a portion of the mail sorting system 10 along a mail piece guidance track or platform 36. As shown in FIG. 4, there are three mail pieces 26; a first mail piece 26*a*, a second mail piece 26*b* and a third mail piece 26*c*, respectively. As used herein, pitch P is defined as the distance between the leading edge 28*a* of a first mail piece 26 such as mail piece 26*a* and the leading edge of a second mail piece 26 such as mail piece 26*b*. With respect to the second mail piece 26*b*, the pre-gap G' is the distance between the trailing edge 30*a* of the first mail piece 26*a* and the leading edge 28*b* of the second mail piece 26*b*. With respect to the second mail piece 26*b*, the post-gap G is the distance between the trailing edge 30*b* of the second mail piece 26*b* and the leading edge 28*c* of the third mail piece 26*c*.

As shown in FIG. 1, the mail pieces 26 enter the conveyor belts 14 through the feeder 16. In the exemplary sorter system presented in FIG. 2, the feeder 16 may include a mail piece input module and an imaging module (e.g., an integrated reader system and optical character recognition engine). The feeder 16 may be set to deliver the mail pieces 26 to the conveyor belts 14 at the input position $I_f$ based on a timing control, a pitch control or a gap control mechanism (e.g., as regulated by the processor/controller 24) in order to ensure there is an adequate pre-gap and post gap for each mail piece 26 to be properly handled, processed or otherwise acted on or measured by the various devices. As further shown in FIG. 1, immediately downstream of the feeder 16 at the feeder output position $O_f$ is a sensor 12*a* that measures the pre-gap, length and post gap of each nail piece 26 passed from the feeder 16 into the conveyor belts 14. This sensor 12*a* singularly or in combination with other upstream sensors, for example, sensor 11 verifies the feeder 16 is operating properly and also populates the processor/controller 24 with the initial measurements of pre-gap length, post-gap length and mail piece length for each mail piece 26. Depending on the application, those skilled in the art may chose to measure and track various combinations of pre-gap, post-gap and length at any of the plurality of sensors along the transport path.

The sensors 12 used in the example shown in FIG. 1 are infrared radiators and receivers. However it is contemplated that any photovoltaic sensors or other sensing mechanisms may be used in place of or in combination with the sensors 12 shown in FIG. 1. In addition, one or more rotary encoders 35 (shown in FIG. 4) may be utilized in connection with the sensors 12 in order to translate the sensor data into codes and/or instruction triggers to be interpreted by the processor/controller 24. The encoders 35 may be one or a combination of rotary encoders, linear encoders or any other like devices. The net result of encoder output is to provide a representation of conveyer belt speed.

The measurements of pre-gap G', length L and post-gap G in the example shown in FIG. 4 are compiled and stored using a 64-bit value by the processor/controller 24 in response to data received from the sensors 12, whether directly and/or via the encoders 35. Pre-gap G' is measured by calculating a value (e.g., distance) resulting from a period of time starting when the sensor 12 is unblocked (e.g., there is not a mail piece 26 adjacent to the sensor) to the moment the sensor 12 is blocked (e.g., there is a mail piece 26 adjacent to the sensor). Similarly, length L is measured from the moment the sensor 12 is blocked to the moment the sensor 12 is unblocked. Finally, the post-gap G is measured from the moment the sensor 12 is unblocked to the moment the sensor 12 is blocked. The measurements may be calculated by the processor/controller 24 based on data supplied from the sensors 12 in lengths of hundredths of inches or in time values of milliseconds, to ensure precise measurements.

Of particular relevance to the teachings herein, the above described measurements are calculated and stored by the processor/controller 24 in data tables that include values for the current (i.e., growing) measurements as well as the final (i.e., static) measurements, with separate tables wherein the values are stored/sorted by sensor 12 and by mail piece 26. For example, each mail piece 26 can be assigned an identification based on the order it is passed through the mail sorting system 10 or, when an image lift system (not shown) is employed, by a mail piece identification generated or read by the image lift system. It is further understood that the measurement data may be supplied to the processor/controller 24 by any subset of the sensors 12 in the mail sorting system 10. For example, in the embodiment shown in FIG. 1, all of the sensors 12 may be used for jam detection, but only sensors 12*a*-*h* are used for gap length measurements. Alternatively, the measurements may be made by any number of sensors 12 and calculated and stored by the processor/controller 24 in any manner apparent to one of ordinary skill in the art.

FIG. 1 further illustrates virtual sensor positions 32 between the sensors 12. The virtual sensor positions 32 illustrate positions along the mail sorting system 10 wherein the processor/controller 24 updates its tables of stored values to predict the position of each mail piece 26. Therefore, at any given time in the operation of the mail sorting system 10, the processor/controller 24 will have data tables storing the values of the mail pieces 26 passing every sensor 12 and virtual sensor position 32. Those with ordinary skill in the art will appreciate that this persistent updating of measurement data throughout the operation of the mail sorting system 10, and particularly the fact that such data may be used to control further processing events, as will be described in further detail below, may improve the operating efficiency of the system by avoiding costly stoppages or other errors.

Figure 3:
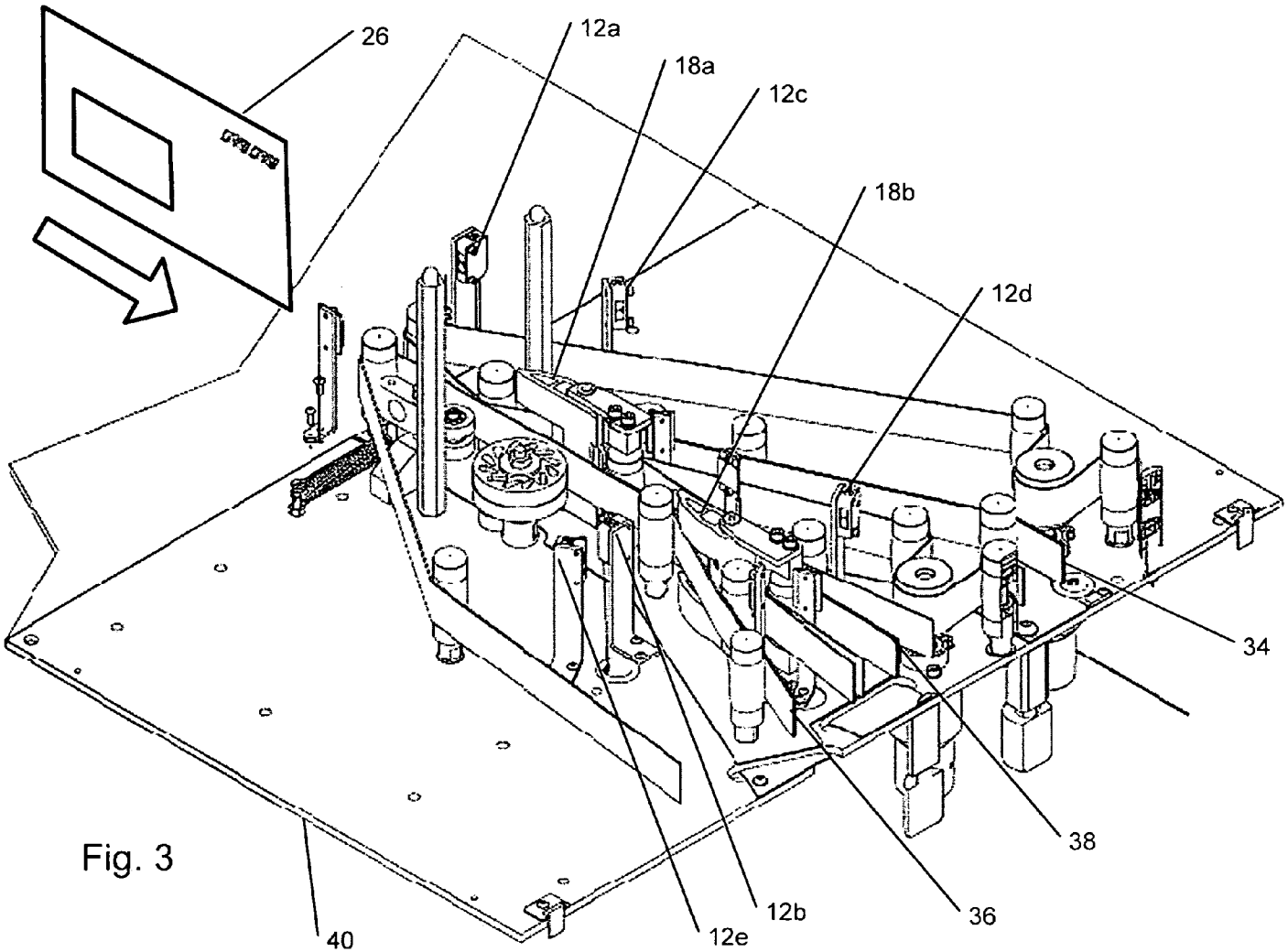
FIG. 3 is a detailed illustration of a mail piece diverter system as employed along the mail transport path of the sorter system shown in FIG. 1.

In the example shown in FIG. 1, and in greater detail with respect to the mail piece diverter system 40 depicted in FIG. 3, the first diverter 18*a* diverts mail pieces 26 onto a first conveyor branch 34, the second diverter 18*b* diverts mail pieces 26 to a second conveyor branch 36 and mail pieces 26 not diverted by either diverter 18 pass through along the main conveyor branch 38. The first conveyor branch 34 includes a first in-line scale 20*a* and the second conveyor branch 36 includes a second in-line scale 20b (the scales 20 are not shown in FIG. 3). At the end of each of the first conveyor branch 34 and the second conveyor branch 36, the mail pieces 26 are returned to the main conveyor branch 38.

When a mail piece 26 passes from the feeder 16 past the first sensor 12*a*, the processor/controller 24 decides whether to actuate the first diverter 18*a* to divert the mail piece 26 onto the first conveyor branch 34. If the first diverter 18*a* is not instructed to actuate to divert a given mail piece 26, the processor/controller 24 decides whether to actuate the second diverter 18*b* as the mail piece 26 passes the second virtual sensor position 32 (i.e., the virtual sensor position 32 directly upstream of the first diverter 18*a*). If neither diverter 18 is able to divert a particular mail piece 26 (e.g., the mail piece 26 will pass the diverter 18 before the diverter 18 recovers from a previous diversion), or the processor/controller 24 had determined there is some error with the mail piece 26 (e.g., the upstream sensors 12 have shown the mail piece 26 to have a changing length indicating a double piece error) the mail piece 26 passes straight through the main conveyor branch 38 without being diverted. For example, the diverters 18 may be instructed not to activate when the pre-gap or post-gap is too small.

Alternatively, when a decision is made to divert a mail piece 26 along the first conveyor branch 34 or second conveyor branch 36 due to activation of the first diverter 18*a* or second diverter 18*b*, respectively, further downstream sensors 12 are employed. For example, sensors 12*b* and 12*c* may be employed to track the mail piece 26, verify its current path and determine if any jams have occurred as a result of improper diversion of a lagging mail piece 26 through diverter 18*a*. Similarly, sensors 12*d* and 12*e* may be employed for tracking and path verification. Prior to contact with a respective scale 20 and thereafter additional sensors may be employed. As previously stated, the data tables compiled in the processor/controller 24 may be updated at each sensor 12 and tracked at virtual sensor 32 or any subset of sensors 12 and virtual sensors 32.

Controlling the action of the diverters 18 to prevent a diverter 18 from attempting to divert a mail piece 26 before the diverter 18 has been given a chance to recover from previous activity may prevent jams or other errors that would require a system stoppage. Preventing system stoppages is critical to maximizing system productivity. Hence, persistent updating of the current and final pre-gap G', post-gap G, and length L information relative to each mail piece 26 arms the controller/processor 24 with feedback data, such that as an example, it may modify the behavior of a subsequent sensor or processing device in advance of the sensor's or device's actual processing of each mail piece 26. It is contemplated that the processor/controller 24 may in some instances use data compiled from an upstream sensor 12 when controlling the actions of a particular device. For example, the processor/controller 24 in the mail sorting system 10 shown in FIG. 1 may control the second diverter 18*b* based on data compiled from sensor 12*a* and the data received from sensor 12*b* is used simply to update the data tables. Alternatively, data received from sensor 12*b* may be used by the processor/controller 24 to control the operation of the second diverter 18*b*.

As further shown in FIG. 1, the mail pieces 26 pass from the first conveyor branch 34 and the second conveyor branch 36 back to the mail conveyor branch 38 after they have been weighed by the in-line scales 20. On the main conveyor branch 38, the mail pieces 26 are transported past a printer 22. Printers 22 require a set time between mail pieces 26 in order to properly function. For example, certain printers 22 will dump the memory buffer containing the information required to print to a first mail piece 26 when the information required to print to a second mail piece 26 is received. Accordingly, if the information for the second mail piece 26 is received before the first mail piece 26 is completed being printed, a printing error may occur. Therefore, operation of the printer 22 may be controlled by the processor/controller 24 to minimize and track printing errors. For example, the processor/controller 24 may choose not to print to a mail piece 26 if the trailing mail piece 26 is too close. Such a decision is made possible by the controller/processor 24 using the data compiled/updated at sensors 12*g* and/or 12*f*; measurements known prior to engagement of the mail piece 26 with sensor 12*h*, which is used in this example to trigger the printer 22.

Although the examples provided above with respect to FIG. 1 relate to controlling the actions of diverters 18 and a printer 22, it is understood that the subject matter disclosed herein is equally applicable to any aspect of the mail sorting system 10 that has a set reaction/response time, whether hardware or software. One example is the in-line scales 20. The present subject matter may be used to control any action, inaction, mechanical process, electrical process, etc.

An advantage of the mail sorting system 10 described herein is that the true throughput capability of the mail sorting system 10 can be determined by analyzing the theoretical gap length capability and the actual gap lengths measured. Accordingly, even if only four mail pieces 26 are passed through the mail sorting system 10 in a given hour, the measurements can be used to determine that the mail sorting system 10 is running at a pace capable of, for example, fifty thousand pieces per hour.

Another advantage of the mail sorting system 10 described herein is that system diagnostics can be based on whether the gap lengths are changing at a particular point along the mail sorting system 10. This can be used to determine component failure or other diagnostics. Indeed, relative conveyor belt acceleration rates may be adapted at points of diagnosed gap variation as a means of maintaining substantially optimal performance.

Figure 5:
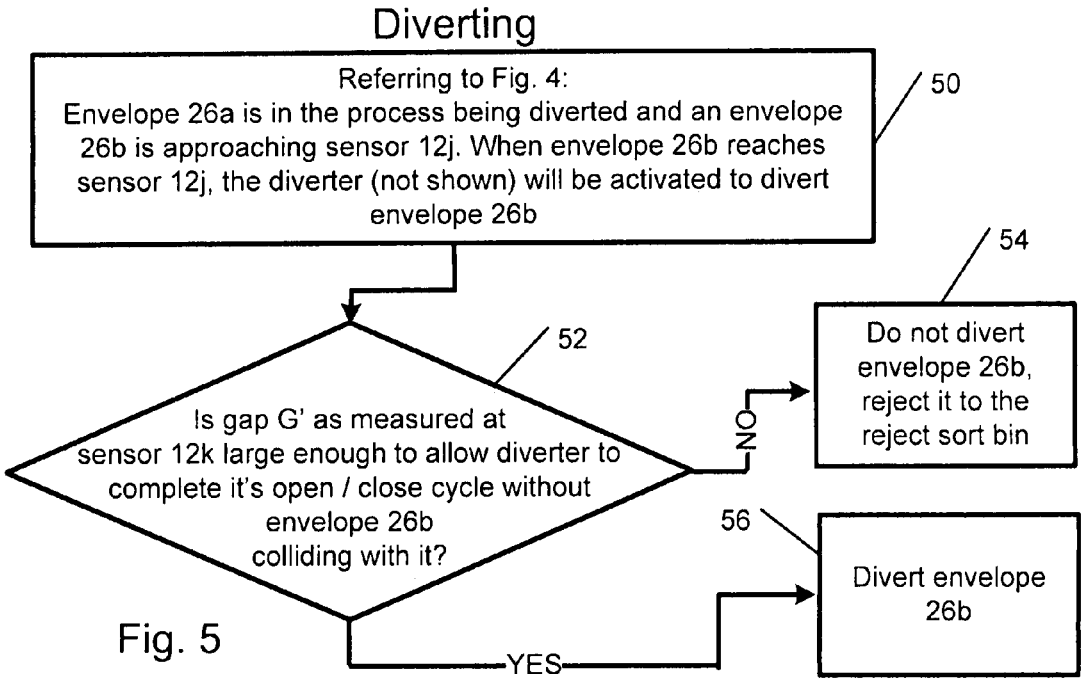
FIG. 5 is an exemplary decision flow for using gap length to determine if a mail piece should be diverted.
Figure 6:
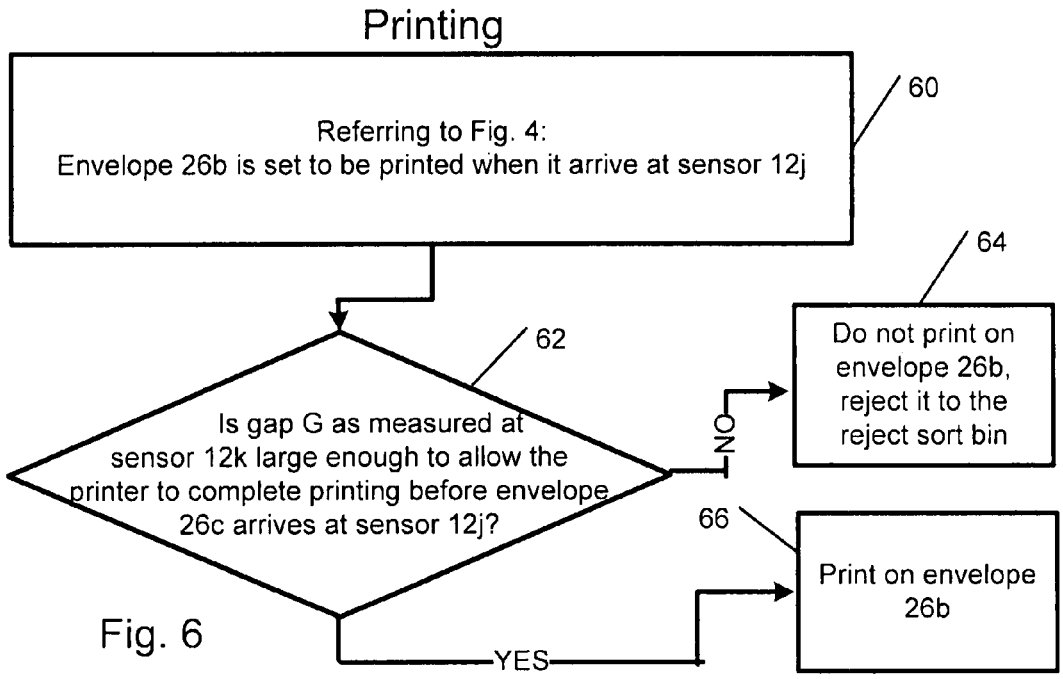
FIG. 6 is an exemplary decision flow for using gap length to determine if a mail piece should be printed.

FIGS. 5 and 6 provide an exemplary decision flow for using gap length to determine if a mail piece should be diverted or printed under the control of the processor/controller 24. These examples are not intended to limit how those skilled in the art might implement alternative approaches. Both figures refer to FIG. 4 to show the relative positions of mail pieces and sensors. As Shown in FIG. 5 (diverting) step 50, an envelope 26*a* is being conveyed by belts 14 through a diverter (not shown). The diverter was activated, when the envelope 26*a* first blocked sensor 12*j*, and will be in the process of closing to the no diversion position. For this example, envelope 26*b* is also set to be diverted when it reaches sensor 12*j*. Even though gap G' is not yet measured by sensor 12*j*, the value is known since G' for envelope 26*b* was measured and tracked from sensor 12*k* along with other data associated with envelope 26*b*. If gap G' is too small to allow the diverter to complete it's open/close cycle without envelope 26*b* colliding with it 52, the diverter will be inhibited 54 instead of activated when envelope 26*b* arrives at sensor 12*j*, the envelope 26*b* will be rejected to the reject bin since the correct action was not performed on this mail piece. It is assumed of this example that the diverter must be inhibited before envelope 26*b* is detected by sensor 12*j* in order for the system to work correctly. If G' is large enough, envelope 26*b* will be diverted as required 56.

As shown in FIG. 6 (Printing) 60, envelope 26*b* is set to have information printed on the envelope starting shortly after it arrives at sensor 12*j*. If gap G, as measured when envelope 26*b* passed sensor 12*k* and envelope 26*c* arrived at sensor 12*k*, is not large enough to allow the printer to complete printing on envelope 26*b* before envelope 26*c* arrives at sensor 12*j* 62 then printing on envelope 26*b* will have to be inhibited 64. If envelope 26*c* arrives at sensor 12*j* before the printing on envelope 26*b*, the printer will halt printing which would cause a printing error for envelope 26*b*. The decision to not print on envelope 26*b* is only possible since the required gap length data had been measured and tracked at a sensor 12*k* that proceeds the control sensor 12*j*. If the gap G is large enough, envelope 26*b* will be printed.

Figure 7:
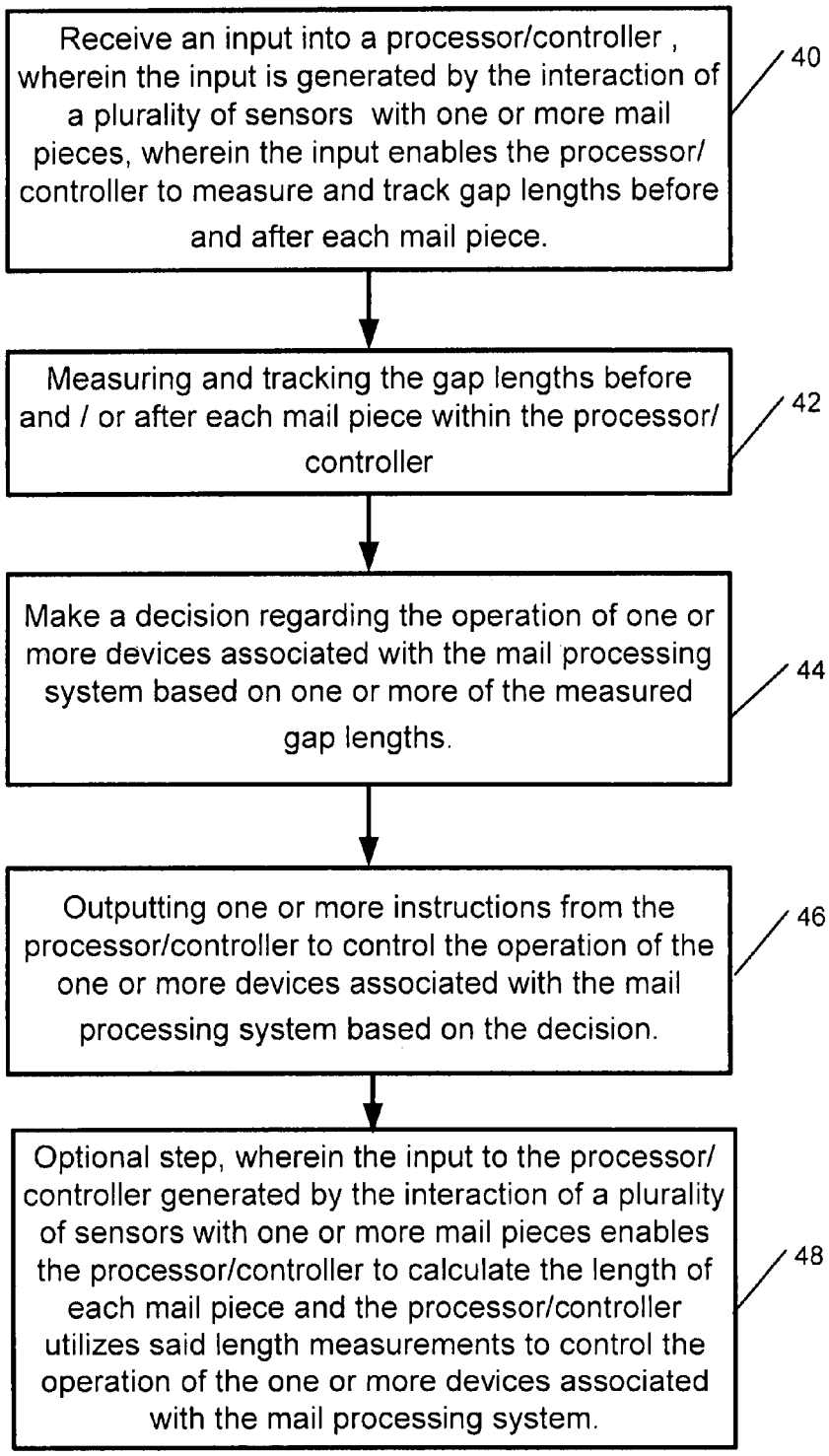
FIG. 7 is a flow chart depicting a method of measuring gap lengths, tracking the gap lengths and controlling operations of a mail processing system based on one or more of the measurements.

FIG. 7 illustrates an example of a method for controlling functions in a mail processing system using a processor/controller 24. The first step 40 shown in FIG. 7 is receiving an input in a processor/controller 24, wherein the input is generated by the interaction of a plurality of sensors 12 with one or more mail pieces 26, wherein the input enables the processor/controller 24 to measure and track gap lengths before and/or alter each mail piece 26. The second step 42 shown in FIG. 5 is measuring and tracking the gap lengths before and/or after each mail piece 26 within the processor/controller 24. The third step 44 shown in FIG. 7 is making a decision regarding the operation of one or more devices associated with the mail processing system based on one or more of the measured gap lengths. The fourth step 46 shown in FIG. 7 is outputting one or more instructions from the processor/controller 24 to control the operation of the one or more devices associated with the mail processing system based on the decision. FIG. 7 also shows an optional fifth step 48 wherein the input to the processor/controller 24 generated by the interaction of a plurality of sensors 12 with one or more mail pieces 26 enables the processor/controller 24 to calculate the length of each mail piece 26 and the processor/controller 24 utilizes said length measurements to control the operation of the one or more devices associated with the mail processing system.

As shown by the above discussion, aspects of the mail processing system are controlled by the processor/controller 24. Typically, the processor/controller 24 is implemented by one or more programmable data processing devices. The hardware elements operating systems and programming languages of such devices are conventional in nature, and it is presumed that those skilled in the art are adequately familiar therewith.

For example, the processor/controller 24 may be a PC based implementation of a central control processing system. The exemplary system contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM, or the like. The system also includes mass storage devices such as various disk drives, tape drives, etc. In operation, the main memory stores at least portions of instructions for execution by the CPU and data for processing in accord with the executed instructions.

The mass storage may include one or more magnetic disk or tape drives or optical disk drives, for storing data and instructions for use by CPU. For example, at least one mass storage system in the form of a disk drive or tape drive, stores the operating system and various application software as well as data, such as received collating instructions and tracking or postage data generated in response to the collating operations. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller 24. For example, the computer may include a graphics subsystem to drive the output display. The output display, for example, may include a cathode ray tube (CRT) display, or a liquid crystal display (LCD) or other type of display device. Although not shown, a PC type system implementation typically would include a port for connection to a printer. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network (to implement the desired processing.

The components contained in the computer system are those typically found in general purpose computer systems. Although illustrated as a PC type device, those skilled in the art will recognize that the class of applicable computer systems also encompasses systems used as servers, workstations, network terminals, and the like. In fact, these components are intended to represent a broad category of such computer components that are well known in the art.

Hence aspects of the techniques discussed herein hardware and programmed equipment for controlling the relevant mail processing as well as software programming, for controlling the relevant functions. A software or program product may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Terms relating to computer or machine "readable medium" that may embody programming refer to any medium that participates in providing code or instructions to a processor for execution. Such a medium may take many forms, including but not limited to non-volatile media, volatile media, and transmission media. Non-volatile media include, for example, optical or magnetic disks, such as any of the storage devices in the computer system. Volatile media include dynamic memory, such as main memory. Transmission media include coaxial cables; copper wire and fiber optics including the wires that comprise a bus within a computer system. Transmission media can also take the form of electric or electromagnetic signals, or acoustic or light waves such as those generated during radio frequency or infrared data communications. In addition to storing programming in one or more data processing elements, various forms of computer readable media may be involved in carrying one or more sequences of one or more instructions to a processor for execution, for example, to install appropriate software in a system intended to serve as the processor/controller 24.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A mail sorting system comprising:

one or more mail transport paths;

a plurality of sensors located downstream from a feeder of the mail sorting system, along the one or more mail transport paths;

a plurality of mail processing devices located along the one or more mail transport paths, each mail processing device being associated with at least one of the sensors preceding a respective mail processing device; and a processor/controller configured to receive input from said sensors, wherein said input is generated by the interaction of one or more of said sensors and mail pieces being directed along one or more transport paths;

wherein said input from said sensors enables the processor/controller to measure gap before and/or after each mail piece and utilize one or more of said gap measurements as compared to a set reaction/response time requirement of one or more of the mail processing devices to determine what interaction should occur in advance of a respective mail piece interacting with said one or more mail processing devices.

2. The system of claim 1 wherein said sensors are photo sensors.

3. The system of claim 1 wherein said sensors are pairs of infrared radiators and receivers.

4. The system of claim 1 wherein said one or more mail processing devices includes a diverter or in-line scale.

5. The system of claim 1 wherein said one or more mail processing devices includes a printer.

6. The system of claim 1 wherein the interaction of said one or more mail processing devices includes activation of said one or more mail processing devices.

7. The system of claim 1 wherein the interaction of said one or more mail processing devices includes inhibition of said one or more mail processing devices.

8. The system of claim 1 wherein said set reaction/response time is a hardware limitation of said one or more mail processing devices.

9. The system of claim 1 wherein said set reaction/response time is a software limitation of said one or more mail processing devices.

10. The system of claim 1 wherein said processor/controller further receives information from said sensors to measure the length of each mail piece and compares the mail piece length information to the set reaction/response time requirement of one or more of the mail processing devices to determine what interaction should occur in advance of the mail piece interacting with said one or more mail processing devices.

11. The system of claim 1 wherein said input from said sensors enables the processor/controller to predict the position of each said mail piece along said one or more transport paths.

12. The system of claim 1, wherein the processor/controller is configured to control operation of one or more of the sensors.

13. The system of claim 1, wherein the gap measurements are based on one or more of: a start and stop time of detection of one or more mail pieces by the plurality of sensors, a determined length of the one or more mail pieces, a detected speed of the one or more mail transport paths, and a known speed of the one or more mail transport path.

14. A method of controlling functions within a mail sorting system using a processor/controller comprising the steps of:

receiving an input in the processor/controller, wherein the input is generated by the interaction of a plurality of sensors with mail pieces, wherein the input enables the processor/controller to measure gap before and/or after each mail piece;

comparing the one or more gap measurements with a set reaction/response time requirement of one or more mail processing devices associated with the mail sorting system; and outputting one or more instructions from the processor/controller to manipulate operation of the one or more mail processing devices in advance of a respective mail piece interacting with the one or more mail processing devices based on the comparing step.

15. The method of claim 14 wherein said sensors are photo sensors.

16. The method of claim 14 wherein said sensors are pairs of infrared emitters and receivers.

17. The method of claim 14 wherein said one or more mail processing devices includes a diverter or in-line scale.

18. The method of claim 14 wherein said one or more mail processing devices includes a printer.

19. The method of claim 14 wherein operation of said one or more mail processing devices includes activation of said one or more mail processing devices.

20. The method of claim 14 wherein operation of said one or more mail processing devices includes inhibition of said one or more mail processing devices.

21. The method of claim 14 wherein said set reaction/response time is a hardware limitation of said one or more mail processing devices.

22. The method of claim 14 wherein said set reaction/response time is a software limitation of said one or more mail processing devices.

23. The method of claim 14 wherein the input to the processor/controller generated by the interaction of a plurality of sensors with mail pieces enables the processor/controller to calculate the length of each mail piece and compares said length measurements to the set reaction/response time requirement of one or more of the mail processing devices associated with the mail sorting system to determine what interaction should occur in advance of the mail piece interacting with said one or more devices.

24. The method of claim 14, further comprising a step of the processor/controller controlling operation of one or more of the sensors.

25. The method of claim 14, further including the step of accounting for the position of the mail pieces relative to said one or more mail processing devices.

26. A computer-readable medium having computer-executable instructions for controlling a mail sorting system, the computer-executable instructions performing the steps of:

receiving an input in a processor/controller, wherein the input is generated by the interaction of a plurality of sensors with mail pieces, wherein the input enables the processor/controller to measure before and after each mail piece;

comparing the one or more gap measurements with a set reaction/response time requirement of one or more mail processing devices associated with the mail sorting system; and outputting one or more instructions from the processor to manipulate operation of the one or more mail processing devices in advance of a respective mail piece interacting with the one or more mail processing devices based on the comparing step.

* * * * *